US011712704B2

(12) United States Patent
Maruyama et al.

(10) Patent No.: US 11,712,704 B2
(45) Date of Patent: Aug. 1, 2023

(54) PAINT DISCHARGING NOZZLE AND METHOD OF CONTROLLING PAINT DISCHARGING NOZZLE

(71) Applicants: Keiko Maruyama, Miyagi (JP); Shohei Ozawa, Miyagi (JP); Shusei Murai, Tokyo (JP)

(72) Inventors: Keiko Maruyama, Miyagi (JP); Shohei Ozawa, Miyagi (JP); Shusei Murai, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/499,872

(22) Filed: Oct. 13, 2021

(65) Prior Publication Data

US 2022/0111405 A1 Apr. 14, 2022

(30) Foreign Application Priority Data

Oct. 14, 2020 (JP) ..... 2020-173140

(51) Int. Cl.
*B05B 1/30* (2006.01)
*B05D 1/02* (2006.01)

(52) U.S. Cl.
CPC ..... *B05B 1/3026* (2013.01); *B05D 1/02* (2013.01)

(58) Field of Classification Search
CPC ..... B05B 1/3026; B05D 1/02
See application file for complete search history.

(56) References Cited

U.S. PATENT DOCUMENTS

| | | | | |
|---|---|---|---|---|
| 4,628,330 | A | 12/1986 | Suga et al. | |
| 8,801,131 | B2 | 8/2014 | Kaiba et al. | |
| 8,936,336 | B2 | 1/2015 | Yokomaku | |
| 9,033,464 | B2 | 5/2015 | Kaiba et al. | |
| 10,339,430 | B2 | 7/2019 | Kaiba et al. | |
| 10,691,987 | B2 | 6/2020 | Kaiba et al. | |
| 10,737,490 | B2 | 8/2020 | Kaiba et al. | |
| 10,987,927 | B2 | 4/2021 | Kaiba et al. | |
| 11,003,964 | B2 | 5/2021 | Kaiba et al. | |
| 2009/0090333 | A1* | 4/2009 | Spadafora | F02D 41/2096 123/494 |

(Continued)

FOREIGN PATENT DOCUMENTS

| | | |
|---|---|---|
| JP | S55-049273 | 4/1980 |
| JP | 2004-142382 | 5/2004 |

(Continued)

OTHER PUBLICATIONS

Extended European Search Report dated Mar. 1, 2022 in European Patent Application No. 21201839.4, 10 pages.

*Primary Examiner* — Nathan T Leong
(74) *Attorney, Agent, or Firm* — Xsensus LLP

(57) ABSTRACT

Disclosed is a paint discharging nozzle designed for discharging paint supplied at a predetermined pressure. The paint discharging nozzle includes a housing having a nozzle hole through which paint is discharged; a paint chamber configured to supply paint to the nozzle hole; a needle valve disposed in the paint chamber, the needle valve having a tip end configured to close or open the nozzle hole; a driving mechanism configured to drive the needle valve to advance toward and retract from the nozzle hole; and a synthetic resin layer formed to cover the tip end of the needle valve.

17 Claims, 7 Drawing Sheets

(56) References Cited

U.S. PATENT DOCUMENTS

| | | | | |
|---|---|---|---|---|
| 2012/0105522 | A1* | 5/2012 | Wallsten | B41J 2/17596 347/44 |
| 2019/0337005 | A1* | 11/2019 | Fritz | B05C 5/0275 |
| 2020/0023580 | A1 | 1/2020 | Kaiba et al. | |
| 2020/0031117 | A1 | 1/2020 | Kaiba et al. | |

FOREIGN PATENT DOCUMENTS

| | | |
|---|---|---|
| JP | 2014-162221 | 9/2014 |
| JP | 2015-027636 | 2/2015 |

* cited by examiner

PAINT DISCHARGING NOZZLE AND METHOD OF CONTROLLING PAINT DISCHARGING NOZZLE

CROSS-REFERENCE TO RELATED APPLICATION

The present application is based on and claims priority under 35 U.S.C. § 119 to Japanese Patent Application No. 2020-173140, filed on Oct. 14, 2020, the content of which is incorporated herein by reference in its entirety.

BACKGROUND OF THE INVENTION

1. Field of the Invention

The disclosures discussed herein relate to a paint discharging nozzle and a method of controlling the paint discharging nozzle.

2. Description of the Related Art

In the automobile manufacturing process, for example, in a case of applying two color-painting (also called "2-tone painting") to the surface of the automobile body, paint is sprayed in the form of mist by a spray gun. In this case, the automobile body is masked, and paint is subsequently sprayed onto the masked surface of the automobile body by a spray gun, thereby forming a boundary line.

RELATED ART DOCUMENTS

Patent Documents

[Patent Document 1] Japanese Patent Application Laid-Open No. 2015-027636

[Patent Document 2] Japanese Patent Application Laid-Open No. 2004-142382

SUMMARY OF THE INVENTION

According to an embodiment of the present invention, a paint discharging nozzle designed for discharging paint supplied at a predetermined pressure is provided. The paint discharging nozzle includes a housing having a nozzle hole through which paint is discharged;

a paint chamber configured to supply paint to the nozzle hole;

a needle valve disposed in the paint chamber, the needle valve having a tip end configured to close or open the nozzle hole;

a driving mechanism configured to drive the needle valve to advance toward and retract from the nozzle hole; and a synthetic resin layer formed to cover the tip end of the needle valve.

Further, according to another embodiment of the present invention, a method of controlling a paint discharging nozzle is provided. The method includes closing a nozzle hole with a tip end of a needle valve by an advance operation of the needle valve toward the nozzle hole through which paint is discharged; and opening the nozzle hole by a retraction operation of the needle valve from the nozzle hole, wherein in the opening, a retraction velocity of the needle valve is higher than a deformation restoration velocity of a synthetic resin layer covering the tip end of the needle valve.

DETAILED DESCRIPTION OF THE PREFERRED EMBODIMENTS

In the related art technology described above, the masking of the automobile body and removing the mask after the paint application is burdensome, and the work efficiency is degraded. Thus, attention has been attracted to a method of forming a boundary line using a paint discharging nozzle having a narrow discharging width without masking the automobile body.

For example, Patent Document 1 discloses an application device having a paint discharging nozzle. The application (print) device disclosed in Patent Document 1 includes a head array (ink jet nozzle head). The head array includes a plurality of paint discharging nozzles disposed in array to inject compressed air and apply high pressure to the ink tank filled with paint so as to discharge the paint to a remote area.

The application device further includes a linear rail for moving the head array back and forth in a linear manner, a multi-articulated robot for moving the linear rail by the robot arm, and a controller for controlling the driving of the robot and the ink jet nozzles. In the head array, a plurality of nozzles arranged in a horizontal array discharges each paint color from the nozzles while moving (scanning) on the linear rail in the array direction.

Such an application device discharges the paint from a plurality of nozzles arranged in a linear manner along the scan direction, so that a film having a desired thickness can be formed by a small amount of scanning operation. This enables an application operation involving boundary lines at a high velocity without performing a masking process.

Figure 5B:
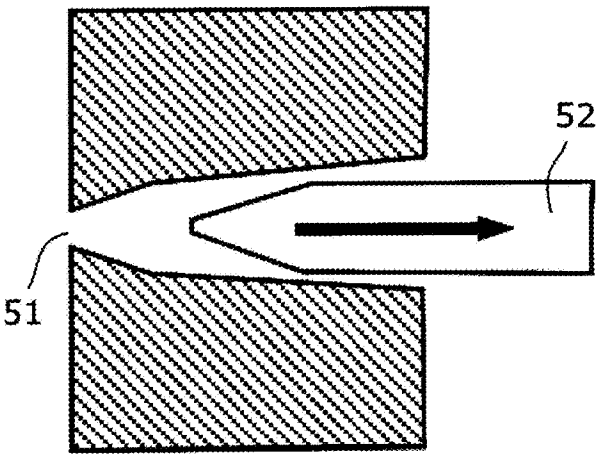
FIGS. 5A and 5B are cross-sectional views illustrating opening and closing operations of the nozzle tip end of a spray gun.
Figure 5A:
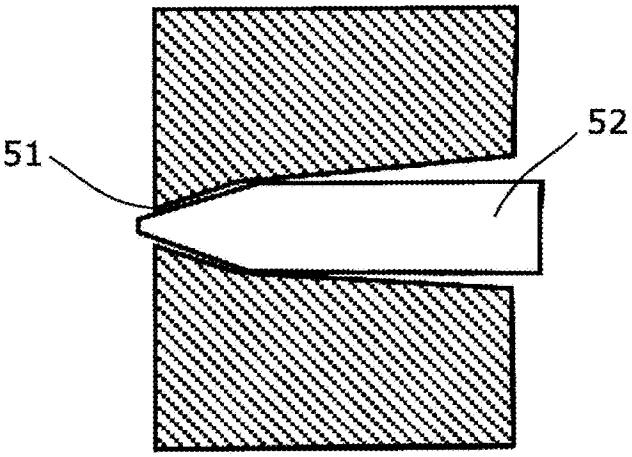

In general, a nozzle tip end of the spray gun or the like is configured to open and close a nozzle hole 51 formed at a nozzle tip, as illustrated in cross-sectional views in FIGS. 5A and 5B, by advancing and retracting operations of a needle 52 with respect to the nozzle hole 51. That is, when the nozzle is closed, the needle 52 advances (is plugged) into the nozzle hole 51, and when the nozzle is opened, the needle 52 is retracted from the nozzle hole 51. In the case of a spray gun, the diameter of the nozzle hole 51 is 0.3 mm, the diameter of the needle 52 is 1.0 mm, and a tip end of the needle is reduced in diameter to form a sharp point.

In the case of the paint discharging nozzle, the nozzle hole is formed to be smaller (e.g., 0.1 mm in diameter) than the nozzle hole of the nozzle of the spray gun. Thus, it is difficult to machine the needle end to be inserted into the nozzle hole.

Figure 6B:
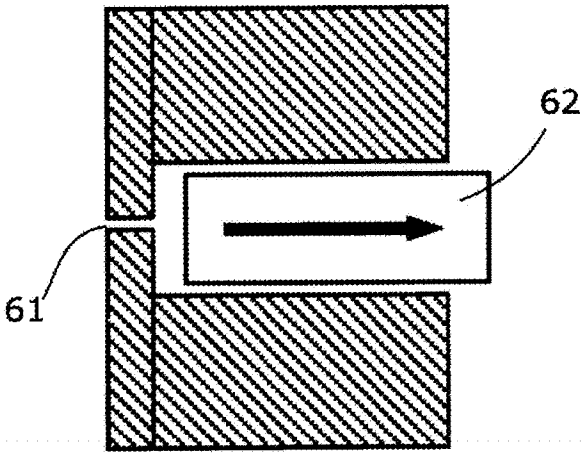
FIGS. 6A and 6B are cross-sectional views illustrating opening and closing operations of the nozzle tip end of the paint discharging nozzle.
Figure 6A:
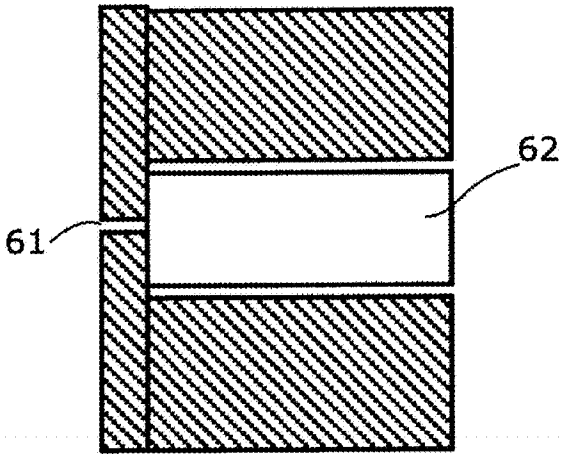

As illustrated in the cross-sectional views of FIGS. 6A and 6B, a needle 62 end is formed in a flat form, and when the nozzle is closed, an end surface of the needle 62 is touched against the nozzle hole 61 to block the nozzle hole 61.

In addition, paint is highly viscous and has a high resistance to fluid flow. Patent Document 2 discloses a paint discharging nozzle capable of preventing paint at a nozzle tip end from being clogged by forming a large gap between a periphery of the needle tip end and an inner wall of the nozzle (a paint passage), and securing a large needle stroke.

Figure 7:
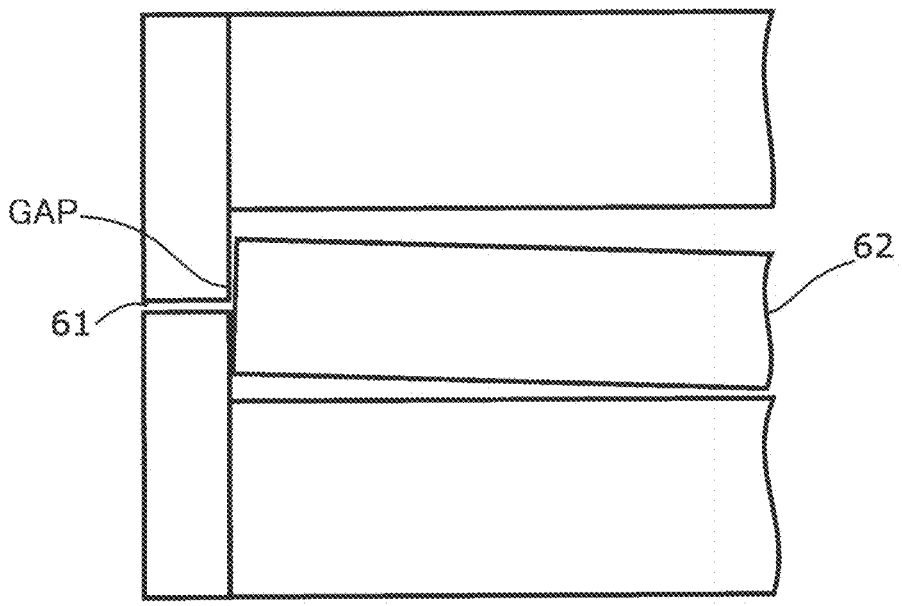
FIG. 7 is a cross-sectional view illustrating a problem in the paint discharging nozzle.

However, when the width (area) of the paint passage and the needle stroke are increased, the installation accuracy is likely to vary, and as illustrated in FIG. 7, the end surface of the needle 62 is tilted when the nozzle is closed. This results in forming a gap between the needle 62 and the nozzle hole 61, resulting in a risk of liquid leakage. When such a liquid leakage has occurred, the discharged liquid is attracted by the surface tension of the leaked liquid, and the straightness of the discharged liquid is hindered.

Further, when the liquid leakage has occurred, a difference in the width of the paint passage has occurred at the nozzle hole 61 caused by the tilted end surface of the needle 62 with respect to the nozzle hole 61. This results in a difference in the discharge velocity, splitting of the droplets after being discharged, and making the liquid passage non-uniform, thereby decreasing in the liquid application accuracy.

It is desirable to provide a paint discharging nozzle and a method of controlling the paint discharging nozzle, wherein the paint discharging nozzle can prevent a liquid leakage when the nozzle hole is in a closed state, and obtain a stable liquid application accuracy when the nozzle is opened.

According to an embodiment of the present invention, when the needle valve opens the nozzle hole, it is preferable that the driving mechanism cause the needle valve to retract from the nozzle hole at a velocity higher than a deformation restoration velocity of the synthetic resin layer. In addition, it is preferable that the Young's modulus of the synthetic resin layer be set to be in the range of 5.6 to 8.3 MPa.

As described above, a synthetic resin layer having a predetermined thickness is formed to cover a tip end of the needle valve. Accordingly, when the nozzle hole is pressed by the tip end of the needle valve, and the tip surface of the needle valve is tilted, the synthetic resin layer deforms to completely close the nozzle hole.

Hereinafter, embodiments of the paint discharging nozzle according to the present invention and the control method of the paint discharging nozzle will be described with reference to the accompanying drawings. The paint discharging nozzle according to the present embodiment is used, for example, in an application device in an automobile manufacturing line, and discharges paint for example, 2-tone painting (having a boundary line with the other color of painting).

Figure 1:
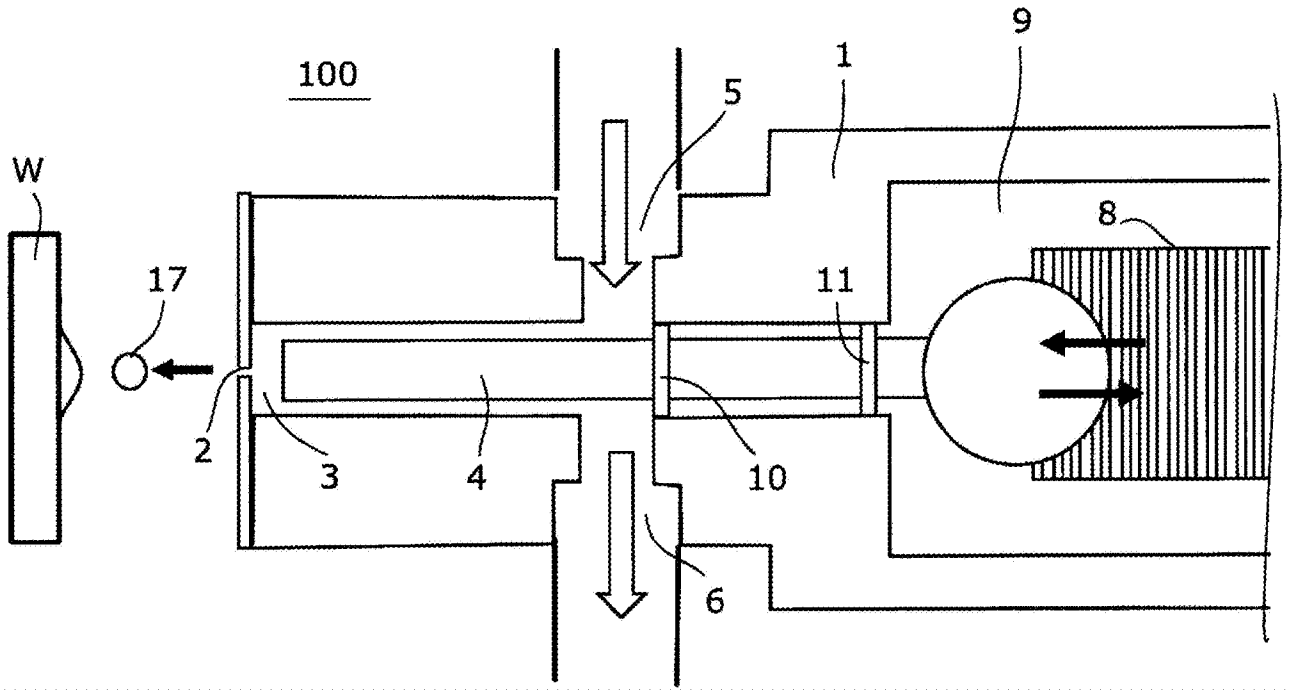
FIG. 1 is a block diagram schematically illustrating a main configuration of a paint discharging nozzle according to the present embodiment.

FIG. 1 is a block diagram schematically illustrating a main configuration of a paint discharging nozzle 100 according to the present embodiment. The paint discharging nozzle 100 includes a nozzle hole 2 provided in the front surface of the housing 1, a paint chamber 3 formed in the housing 1 to supply paint to the nozzle hole 2, a needle valve 4 located in the paint chamber 3 and having a tip end to close or open the nozzle hole 2, and a piezo-element 8 as a driving mechanism fixed to a rear side of the needle valve 4.

A paint input passage 5 is connected to one side of the paint chamber 3, and a paint collection passage 6 is connected to the opposite side of the paint chamber 3. The paint chamber 3 is constantly supplied with the paint from a paint supply unit (not illustrated) through the paint input passage 5, and is collected from the paint collection passage 6. Thus, the paint is filled without any paint stagnation. When the nozzle hole 2 is in a closed state, a predetermined pressure is maintained in the paint chamber 3 by adjusting the flow rate of the paint from the paint input passage 5.

When a predetermined voltage is applied by a voltage application unit (not illustrated), the piezo-element 8 changes the axial length of the needle valve 4 and moves (advances) the needle valve 4 toward the nozzle hole 2. This closing procedure allows the tip end of the needle valve 4 to close the nozzle hole 2 (the nozzle hole is in a closed state).

When the applied voltage is lowered from the nozzle closed state, the piezo-element 8 deforms the needle valve 4 away from the nozzle hole 2 (the nozzle hole is in an open state). When the nozzle hole 2 is opened according to this opening procedure, the droplets 17 are discharged from the nozzle hole 2 toward a workpiece W by the pressure inside the paint chamber 3 as illustrated in FIG. 1.

The piezo-element 8 is housed in a driving mechanism housing space 9 formed in the housing 1. The driving mechanism housing space 9 is separated from the paint chamber 3 by double O-rings 10 and 11 so that the paint in the paint chamber 3 does not flow into the driving mechanism housing space 9.

Figure 2:
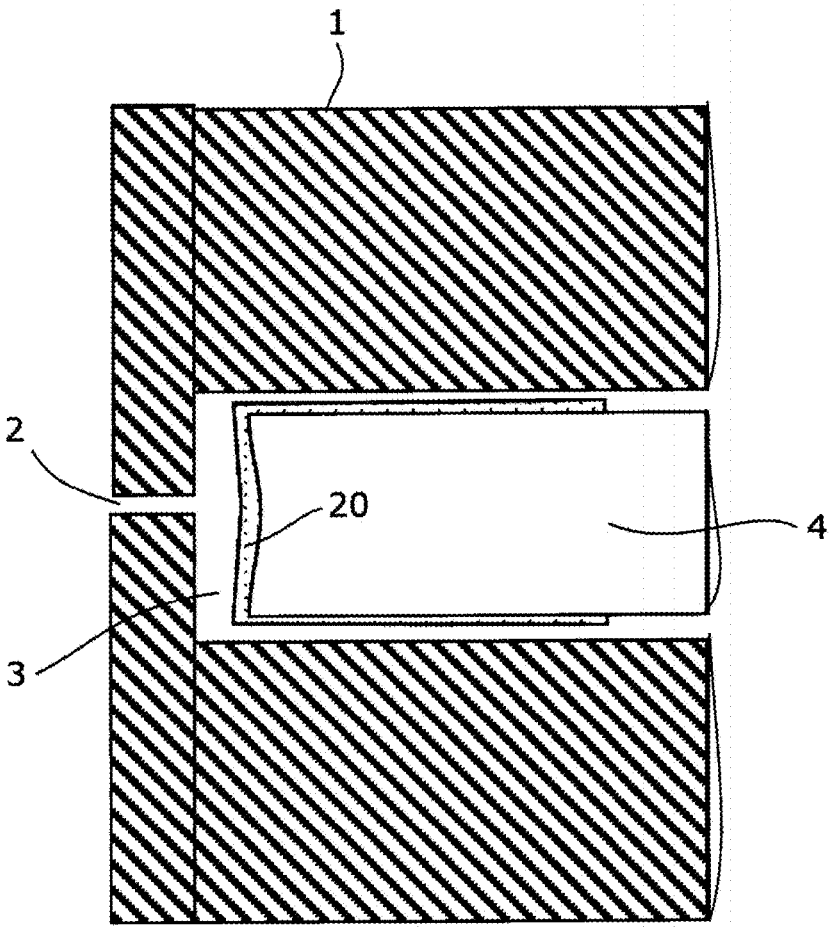
FIG. 2 is a cross-sectional view illustrating an enlarged view of a nozzle hole and a tip end of a needle valve.

FIG. 2 is a cross-sectional view illustrating the nozzle hole 2 and the tip end of the needle valve 4 enlarged. The nozzle hole 2 has a diameter of, for example, 0.1 mm and a length of, for example, 1 mm. The tip end surface of the needle valve 4 is formed in a recess shape so as not to interfere with the nozzle hole 2. A synthetic resin layer 20 set to have a thickness in the range of 0.1 mm to 0.5 mm (e.g., 0.2 mm) is also coated to cover the tip end of the needle valve 4 over a range of 2 mm in the axial direction.

The synthetic resin layer 20 preferably has Young's modulus in a range from 5.6 to 8.3 Mpa, and is formed, for example, from perfluoroelastomers. If the Young's modulus of the synthetic resin layer 20 is lower than 5.6 MPa, the deformation restoration velocity of the compressed synthetic resin layer 20 is low. Thus, the nozzle hole 2 is blocked again by the tip end of the needle valve 4 before the deformation restoration is completed, which causes occurrence of the liquid leakage, and this is undesirable. By contrast, when the Young's modulus is higher than 8.3 MPa, the deformation restoration velocity of the compressed synthetic resin layer 20 is high, and the tip end of the needle valve 4 opens the nozzle hole 2 after the deformation restoration is completed. This unevenly widens the paint passage at a nozzle hole opening moment causing a difference in the paint application velocity. As a result, the straightness of the discharge liquid droplets is not maintained, and this is undesirable.

Figure 3A:
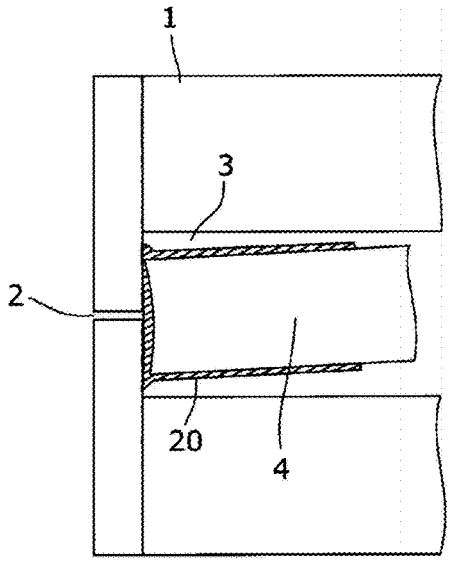
FIGS. 3A to 3C are cross-sectional views illustrating a change in the state of a nozzle hole and a tip end of a needle valve.

In addition, it is desirable that the expansion rate of the synthetic resin layer 20 with respect to water-based paint thinner for cleaning be less than 3%, and it is desirable that the solvent resistance of the synthetic resin layer 20 is less than 5%. When the synthetic resin layer 20 is formed as such at the tip end of the needle valve 4, the synthetic resin layer 20 is deformed to be crushed as illustrated in FIG. 3A. As a result, the nozzle hole 2 can be completely closed by the tip end of the needle valve 4 even when the tip surface of the needle valve 4 is tilted when the nozzle hole is in a closed state.

Figure 3B:
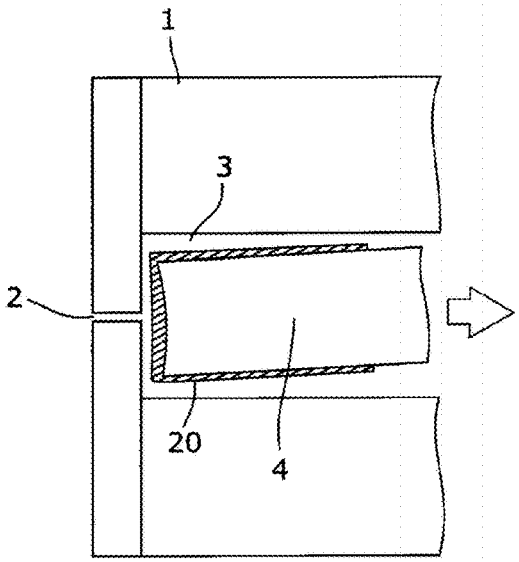
Figure 3C:
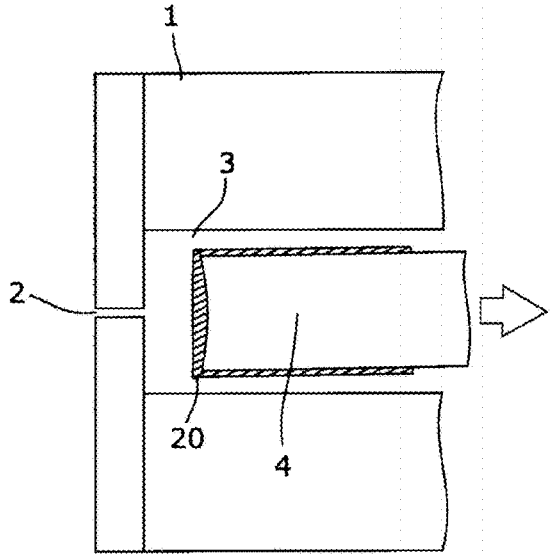
Figure 4:
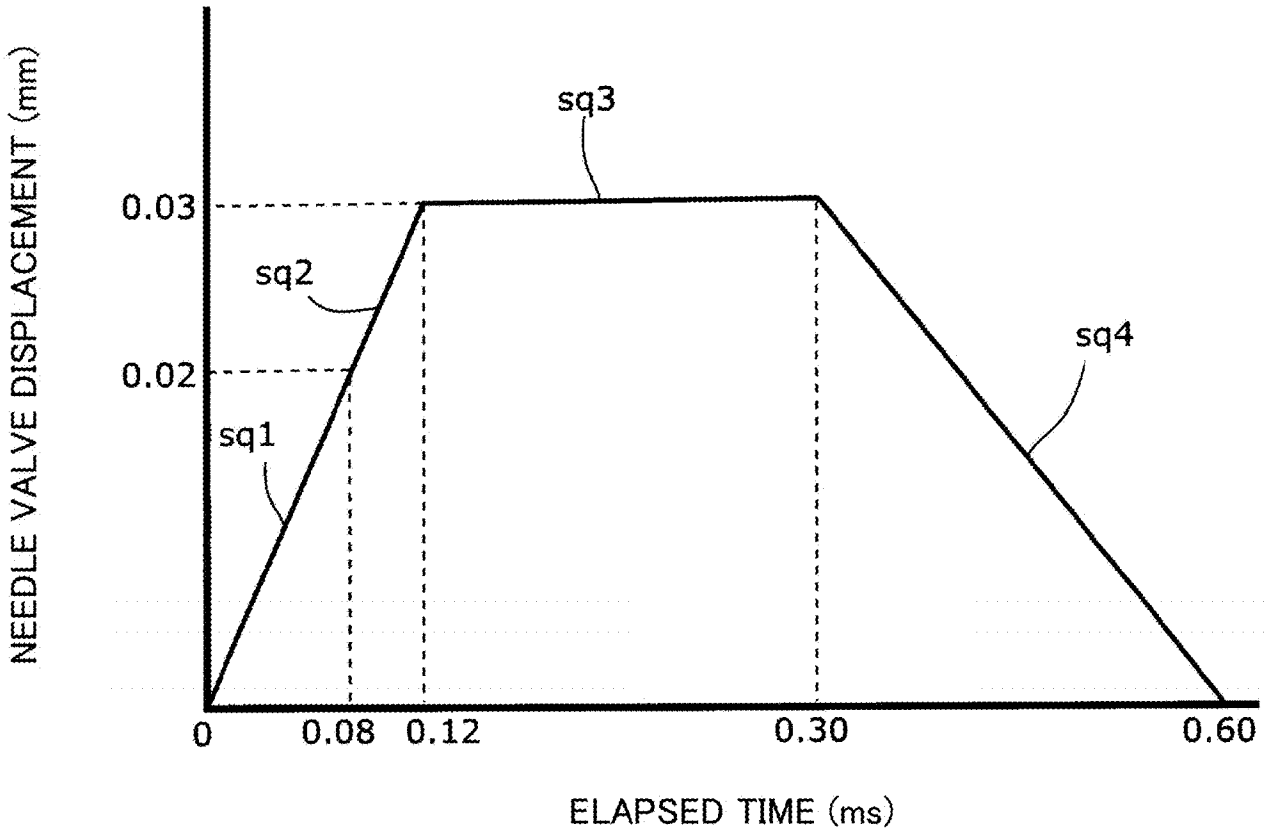
FIG. 4 is a graph illustrating the displacement of a needle valve with respect to the elapsed time.

Next, an operation control for discharging the paint using the paint discharging nozzle 100 configured as described above will be described with reference to FIGS. 3A to 3C, and FIG. 4. FIGS. 3A to 3C are cross-sectional views illustrating a change in the state of a nozzle hole and a tip end of the needle valve. FIG. 4 is a graph illustrating the displacement of the needle valve with respect to the elapsed time. This operation control is achieved by causing a non-illustrated controller (computer) to control the operation of the piezo-element 8 (driving mechanism), and specifically, is achieved by causing the controller to control the value of the voltage applied to the piezo-element 8.

As described above, the state of FIG. 3A (i.e., the nozzle hole 2 is completely closed) illustrates that the tip end of the needle valve 4 blocks the nozzle hole 2 when the synthetic resin layer 20 is crushed. From this state, the voltage applied to the piezo-element 8 is reduced to zero, and the needle valve 4 begins to retract at a predetermined velocity (e.g., 0.25 mm/ms or more) to a thickness of the synthetic resin layer 20 of, for example, 0.02 mm (Sq1 of FIG. 4). This causes the needle valve 4 to retract and the nozzle hole 2 to open prior to completion of the deformation restoration of the synthetic resin layer 20, as illustrated in FIG. 3B. Further, the width of the paint passage is uniform at the nozzle hole opening moment, and as a result, the difference in the paint application velocity is eliminated, and the straightness of the discharge droplets is maintained.

When the retracted distance of the needle valve 4 exceeds 0.02 mm, the increase rate of the applied voltage is kept low, and the needle valve 4 is further retracted to 0.03 mm at a lower velocity (e.g., less than 0.25 mm/ms) (Sq2 in FIG. 4). This makes the nozzle hole 2 completely open, as illustrated in FIG. 3C.

After opening the nozzle hole 2 (Sq3 in FIG. 4), the deformation of the synthetic resin layer 20 is restored, and when the nozzle hole 2 is closed, the applied voltage to the piezo-element 8 is gradually increased (Sq4 in FIG. 4), the needle valve 4 is gradually advanced (e.g., 0.1 mm/ms or less), and the nozzle hole 2 is closed by pressing the tip end of the needle valve 4 against the nozzle hole 2 to collapse (deform) the synthetic resin layer 20. Thus, the nozzle hole 2 is completely blocked by the synthetic resin layer 20 covering the tip end of the needle valve 4 even though the tip surface of the needle valve 4 is tilted.

When the needle valve 4 advances rapidly to close the nozzle hole 2, the paint around the nozzle hole 2 becomes turbulent, resulting in a turbulent flow. When the paint is pushed, and discharged in this state, droplet separation of the paint is observed, and the painting accuracy is lowered. Thus, according to the present embodiment, as described above, the needle valve 4 is controlled to be gradually advanced (e.g., 0.1 mm/ms or less).

As described above, according to the embodiment of the present invention, the synthetic resin layer 20 having a predetermined thickness is formed so as to cover the tip end of the needle valve 4. Accordingly, when the nozzle hole 2 is pressed by the tip end of the needle valve 4 to close the nozzle hole 2 while the tip surface of the needle valve 4 is tilted, the synthetic resin layer 20 covering the tip end of the needle valve 4 deforms to completely close the nozzle hole 2. In addition, when the nozzle hole 2 is opened, the retraction velocity of the needle valve 4 is increased higher than the deformation restoration velocity of the synthetic resin layer 20. As a result, it is possible to make the area (width) of the paint passage uniform at the nozzle hole opening moment, to eliminate the difference in discharge velocity, and to maintain the straightness of the discharge droplets. Further, when closing the nozzle hole 2, the turbulence around the nozzle hole 2 is reduced by controlling the advancing velocity of the needle valve 4 to be 0.1 mm/ms or less. Thus, it is possible to prevent a decrease in the painting accuracy.

According to the above-described embodiment, the synthetic resin layer 20 is made from, for example, a perfluoroelastomer, but is not limited to this example. Other synthetic resins with Young's modulus in the range of 5.6 to 8.3 Mpa can also be employed.

Example

In this example, a material suitable for a synthetic resin layer covering the tip end of the needle valve was verified. A perfluoroelastomer was used as a material of the aforementioned synthetic resin layer in Example 1, Teflon (registered trademark) (PTFE) was used in Comparative Example 1, and silicon was used in Comparative Example 2. Each material was applied to the synthetic resin layer according to the present embodiment, and the expansion rate of the water-based paint thinner for cleaning, the solvent resistance (time), and the presence or absence of leakage were evaluated. Table 1 illustrates the conditions and results.

TABLE 1

| | Example 1 | Comparative example 1 | Comparative example 2 |
|---|---|---|---|
| Young's modulus | 5.6-8.3 | 8.7-10 | 2.9-3.8 |
| Expansion rate of water-based paint thinner | Superior | Superior | Inferior |
| Solvent resistance (time) | Superior | Superior | Inferior |
| Wettability | Superior | Inferior | Inferior |
| Overall evaluation | Superior | Inferior | Inferior |

The results illustrated in Table 1 indicate that the perfluoroelastomer used in Example 1 is preferable as a material suitable for a synthetic resin layer covering the tip end of the needle valve, and the Young's modulus (MPa) is preferably 5.6 to 8.3.

According to still another embodiment of the present invention, when opening the nozzle hole, the retraction velocity of the needle valve is made higher than the deformation restoration velocity of the synthetic resin layer, thereby making the width (area) of the paint passage uniform at a nozzle hole opening moment, by eliminating the difference in discharge velocity, and by maintaining the straightness of discharged droplets.

EFFECTS OF THE INVENTION

According to the present invention, it is possible to provide a paint discharging nozzle capable of executing a control method of preventing the occurrence of liquid leakage when the nozzle hole is in a closed state and obtaining stable paint application accuracy when the nozzle is opened.

What is claimed is:

1. A paint discharging nozzle designed for discharging paint supplied at a predetermined pressure, the paint discharging nozzle comprising:

a housing having a nozzle hole through which paint is discharged;

a paint chamber to supply paint to the nozzle hole;

a needle valve disposed in the paint chamber, the needle valve having an end to close or open the nozzle hole;

a needle driver to drive the needle valve to advance toward and retract from the nozzle hole, the needle driver including an electric actuator, the electric actuator causing the needle valve to open and close the nozzle hole;

a synthetic resin layer at the end of the needle valve; and a controller to control the electric actuator, wherein when the needle valve opens the nozzle hole, the needle driver causes the needle valve to retract from the nozzle hole at a velocity higher than a deformation restoration velocity of the synthetic resin layer, and wherein the controller causes the electric actuator to slow a speed at which the needle valve opens the nozzle hole by applying a voltage to the electric actuator.

2. The paint discharging nozzle according to claim 1, wherein:

the controller causes the needle valve to close the nozzle hole, after the needle valve has opened the nozzle hole, by applying a voltage to the electric actuator which is higher than a voltage used to slow the speed at which the needle valve opens.

3. The paint discharging nozzle according to claim 2, wherein:

the electric actuator includes a piezo element.

4. The paint discharging nozzle according to claim 1, wherein:

the electric actuator includes a piezo element.

5. A paint discharging nozzle designed for discharging paint supplied at a predetermined pressure, the paint discharging nozzle comprising:

a housing having a nozzle hole through which paint is discharged;

a paint chamber to supply paint to the nozzle hole;

a needle valve disposed in the paint chamber, the needle valve having an end to close or open the nozzle hole;

a needle driver to drive the needle valve to advance toward and retract from the nozzle hole; and a synthetic resin layer at the end of the needle valve, wherein:

the synthetic resin layer includes a surface exposed to the paint chamber, and the surface includes a concave shape.

6. The paint discharging nozzle according to claim 5, wherein:

the synthetic resin layer does not interfere with the nozzle hole when the needle valve closes the nozzle hole.

7. The paint discharging nozzle according to claim 5, wherein:

the synthetic resin layer has Young's modulus in a range from 5.6 to 8.3 MPa.

8. The paint discharging nozzle according to claim 5, wherein:

the synthetic resin layer covers the needle valve in an axial direction of the needle valve.

9. The paint discharging nozzle according to claim 5, wherein:

when the needle valve opens the nozzle hole, the needle driver causes the needle valve to retract from the nozzle hole at a velocity higher than a deformation restoration velocity of the synthetic resin layer.

10. The paint discharging nozzle according to claim 5, further comprising:

a controller to control an electric actuator of the needle valve.

11. The paint discharging nozzle according to claim 10, wherein:

the controller cause the electric actuator to slow a speed at which the needle valve opens the nozzle hole by applying a voltage to the electric actuator.

12. The paint discharging nozzle according to claim 11, wherein:

the controller causes the needle valve to close the nozzle hole, after the needle valve has opened the nozzle hole, by applying a voltage to the electric actuator which is higher than a voltage used to slow the speed at which the needle valve opens.

13. The paint discharging nozzle according to claim 12, wherein:

the electric actuator includes a piezo element.

14. The paint discharging nozzle according to claim 11, wherein:

the electric actuator includes a piezo element.

15. A paint discharging nozzle designed for discharging paint supplied at a predetermined pressure, the paint discharging nozzle comprising:

a housing having a nozzle hole through which paint is discharged;

a paint chamber to supply paint to the nozzle hole;

a needle valve disposed in the paint chamber, the needle valve having an end to close or open the nozzle hole;

a needle driver to drive the needle valve to advance toward and retract from the nozzle hole; and a synthetic resin layer at the end of the needle valve, wherein:

the synthetic resin layer includes a surface exposed to the paint chamber, and the surface includes a recessed shape.

16. The paint discharging nozzle according to claim 15, wherein:

the synthetic resin layer does not interfere with the nozzle hole when the needle valve closes the nozzle hole.

17. The paint discharging nozzle according to claim 15, wherein:

the synthetic resin layer has Young's modulus in a range from 5.6 to 8.3 MPa.

* * * * *